US010238559B1

(12) United States Patent
Khaligh

(10) Patent No.: US 10,238,559 B1
(45) Date of Patent: Mar. 26, 2019

(54) HOSPITAL BED WITH SLIDING DISPOSABLE TOILET PAN

(71) Applicant: Shahzadeh Khaligh, Rancho Palos Verdes, CA (US)

(72) Inventor: Shahzadeh Khaligh, Rancho Palos Verdes, CA (US)

(73) Assignee: Space Technology Research LLC, Rancho Palos Verdes, CA (US)

( * ) Notice: Subject to any disclaimer, the term of this patent is extended or adjusted under 35 U.S.C. 154(b) by 168 days.

(21) Appl. No.: 15/466,828

(22) Filed: Mar. 22, 2017

(51) Int. Cl.

| | |
|---|---|
| ***A61G 7/02*** | (2006.01) |
| ***A61G 7/015*** | (2006.01) |
| ***A61G 7/018*** | (2006.01) |
| ***A61G 7/047*** | (2006.01) |

(52) U.S. Cl.
CPC ..... *A61G 7/02* (2013.01); *A61G 7/015* (2013.01); *A61G 7/018* (2013.01); *A61G 7/047* (2013.01); *A61G 2203/12* (2013.01); *A61G 2203/16* (2013.01)

(58) Field of Classification Search
CPC ..... A61G 7/02
See application file for complete search history.

(56) References Cited

U.S. PATENT DOCUMENTS

| | | | | |
|---|---|---|---|---|
| 718,746 | A * | 1/1903 | Bennett | |
| 2,247,516 | A * | 7/1941 | Murray | A47C 20/041 5/616 |
| 5,535,464 | A * | 7/1996 | Salonica | A61G 7/015 5/604 |
| 2010/0083441 | A1* | 4/2010 | Ishida | A61G 7/002 5/604 |
| 2010/0199429 | A1* | 8/2010 | Patwardhan | A61G 7/015 5/604 |

* cited by examiner

*Primary Examiner* — Sarah B McPartlin

(57) ABSTRACT

Pertaining to hospital bed, development provides comfortable lavatory services to bedridden patients with mobility difficulties. The novelty introduced here is integration of a hospital bed with a bed-level sliding disposable pan at midsection of the bed to allow patients who endure immobility to perform in-bed toileting with no physical pressure and less psychological challenges while remaining clean and sanitized. This invention would best be useful for hospitals, home health care or other health care facilities and settings.

2 Claims, 4 Drawing Sheets

HOSPITAL BED WITH SLIDING DISPOSABLE TOILET PAN

CROSS-REFERENCE TO RELATED APPLICATIONS

1. U.S. Pat. No. 6,594,837 (2003)—In bed toilet, showering, bating and change linen, Acuiline international corporation
2. Slidable midsection with toilet bowl at the mattress section
3. YONGHUI—C05 Luxury Nursing Bed—2017 Hospital Patients Medical Bed With Toilet Adjustable, Hengshui Binhu District
4. Kareway recline chair hospital bed—Model Number: KJW-DF512LN recline chair hospital
5. Automatic Rig medical equipment bed toilet—Model No.:XR.LJ18-02

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not applicable

FOREIGN APPLICATION DATA

N/A

BACKGROUND OF THE INVENTION

This invention introduces a hospital bed that splits open at its mid section to allow a sliding tray containing a built-in bed pan to integrate with the bed. The tray has built-in soap dish next to the pan that operates by pumping cleansing liquid to the affected working area. The bed pan is designed to open at the bottom on a single push button for disposal, and a sliding lid on the top that together provide sanitary in-bed lavatory services. Providing toilet services to patient who suffer from serious physical injury, tolerate sever pain for making a physical move, or totally unable to make a physical move, has been a major challenge in health care facilities. Patients suffer inevitable psychological and physical difficulties to perform this routine procedure on bed. There are numerous reports of bedridden injury of the patient, unable to move, tried alternatives to perform the daily routine; patients have fell down and suffered broken head or other body parts merely because the procedure on the mattress was not acceptable to them.

This invention focuses on a simple method to provide comfortable and easy approach for the patient and the staff to get the job done in a clean, affrodable and economical approach.

There are many different toilet bed models in the international commercial market, although each one has obvious differences from another, generally are part of a more complex and multi functional bed system that narrows the use of the bed. There are models of the bed that convert to a sitting chair with recline foot position (i.e Model Number: KJW-DF512LN), models in which the bed opening is connected to a suction pump via hoses (i.e. Model No.: XR.LJ18-02, 3), a simple model that slides in the mid section of the bed which requires degrees of move of the patient's body, or some additional complicated and sophisticated multi functional bed patented by Acuiline international corporation (U.S. Pat. No. 6,594,837), where not all the functions necessarily can be of use to every patient.

This invention is a simple integration of a bed pan to the midsection of a conventional hospital bed with power driven back lift, head rise, and inclined knee section. This invention can be lessened by eliminating the power driven rise sections of the bed or improved by automating the tray operation by patient. But it certainly is a needed product for hospitals and home cares facilities where they have multi bed rooms and short staff.

SUMMARY OF THE INVENTION

Development permits the patient toileting without having to lift or move his body which at times and under variety of conditions causes severe physical pain; and further, it lessens the psychological stress of the patient. With this development, if required, patient would remain immobile on the bed to get the job done. Additionally, it creates more tolerable situation and sanitary condition for the neighboring bed(s), for patient and care giver(s).

The bed frame consists of a main frame and two powered bracket frames. One bracket frame supports the upper half of the bed and the second bracket frame supports the lower half of the bed. The bed platform consists of four tiltable and moving panels, two on each half section of the bed, that are controlled by the bracket frames and can slide open at the mid section to position a sliding bed pan. The two bracket frames are connected to the main frame of the bed via adjustable vertical power members, and operate on a single electrical motor located under the main frame.

DETAILED DESCRIPTION OF THE INVENTION

Figure 1A:
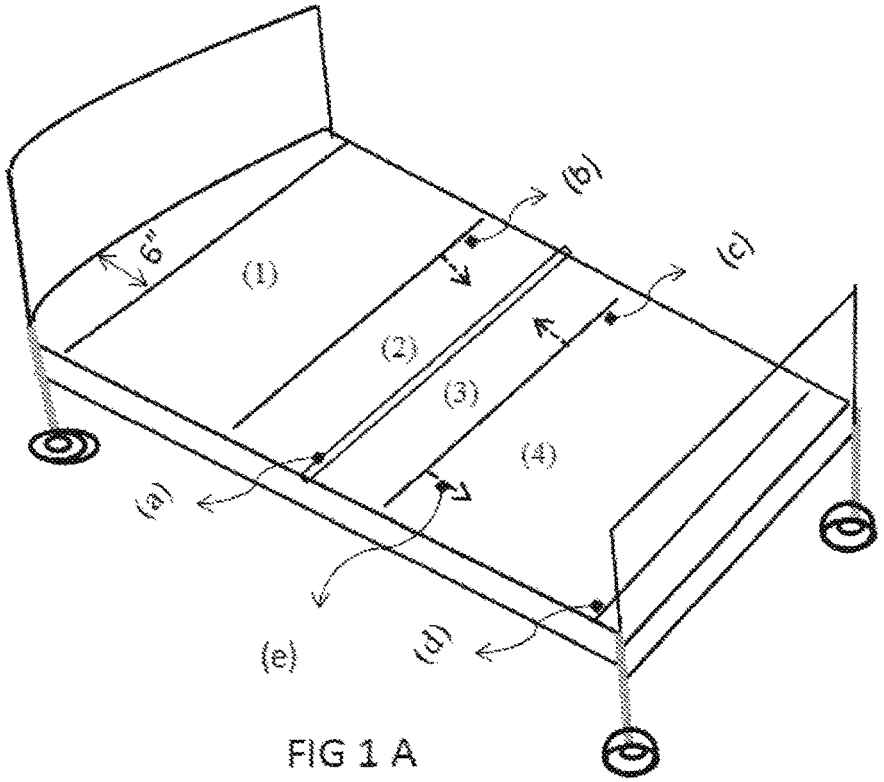
FIG. 1A illustrates the separation lines for the four sections of the bed in a flat configuration. Centerline (a) is the opening line for the tray operated by a keypad or a push button on the side of the bed. A first panel (1) and a second panel (2) are connected together via hinges at line (b); and a third panel (3) and a forth panel (4) are connected together via hinges at line (c). Line (d) illustrates a six inch open space at each end of the bed, adjacent to the headboard and footboard.

Referring to FIG. 1A, the hospital bed has four connected tiltable panels that can tilt and move individually or in combination to reconfigure the bed to different settings. The first panel (1) is immediately adjacent to headboard and it can move at both ends; attached to it via hinges at line (b) is a second panel (2) which is adjacent to centerline (a), and can rise and tilt at its both ends. A third panel (3), at one end makes contact with the second panel at centerline (a) and at the other end connects to a fourth panel (4) at line (c) via hinges that can move and tilt, and the fourth panel, is adjacent to footboard. First panel and second panel form the first half of the bed, and, supported by first bracket frame can adjust to different settings individually or together, and third panel and fourth panel forming the second half of the bed, supported by second bracket frame, can make moves individually or in combinations such as tilting or rising up/down at their movable joints.

There is a six inch open space between the first half of the bed and headboard; and another six inch open space between the second half of the bed and footboard. The first half of the bed is configured to tilt and rise vertically on line (b), and line (d) via additional power members to accommodate a sitting position and also longitudinally move along head-to-foot axis of the bed frame up to six inches where it meets the headboard. Similarly, the second half of the bed is powered to tilt and rise at line (c) to provide knee up position and at line (d) to provide foot up position, and can move longitudinally along the head-to-foot axis up to six inches toward the footboard. The pivotal function is at line (a) where the first half of the bed moves toward the headboard and the second half of the bed moves away in opposite directions toward footboard, together, they open up to twelve inch space at the mid section of the bed for the bed pan tray to slide in as demonstrated in FIG. 3.

Figure 1B:
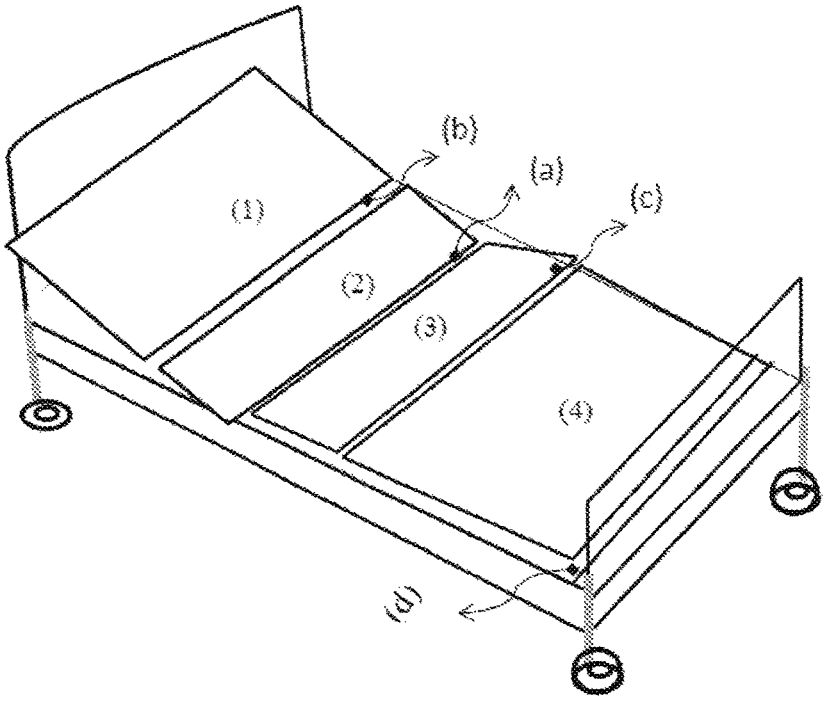
FIG. 1B illustrates the bed where each of first panel (1), second panel (2), third panel (3), and forth panel (4) are lifted to form a different configuration of the bed, particularly a raised backrest and knee section.

Referring to FIG. 1B, first panel and second panel have been uniformly raised at line (b) and line (d) to furnish a head up position; and third panel and fourth panel have tilted up at line (c) to provide a knee up position. Although not easily visible from the drawings, the six inch openings at line (d) are preserved on both end of the bed.

Figure 1C:
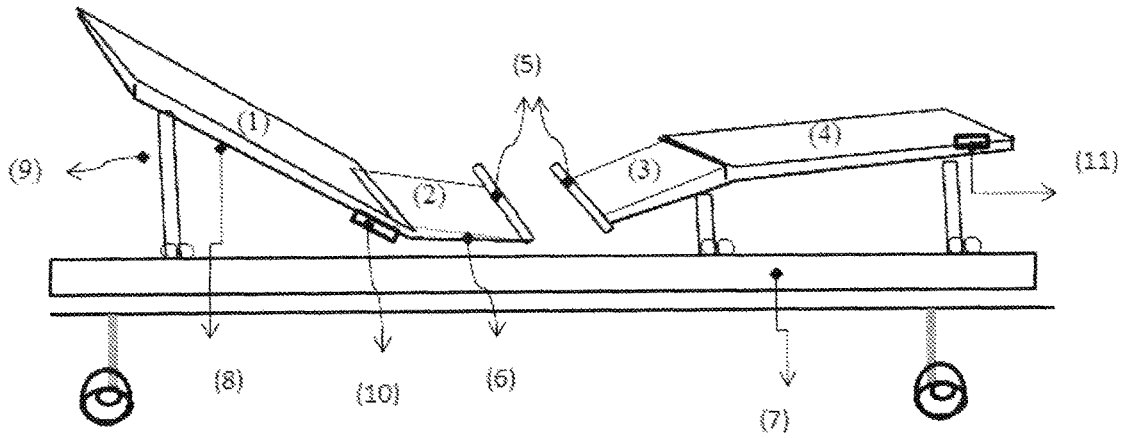
FIG. 1C illustrates the main frame (7), and bracket frame (8) with electromechanical power members (6) under each of first panel, second panel, third panel and fourth panel of the platform. Additionally, it illustrates the two track bars (5) for the sliding tray, the additional power members (9) connecting the bracket frame to main frame, the side push button (10) for opening the midsection at centerline (a), and the wired/wireless keypad (11).

Referring to FIG. 1C, the bed has a main frame (7) and two bracket frames (8). One bracket frame supports the first half section of the bed and the second bracket frame supports the second half section of the bed. Each bracket frame has four sides, and consists of four electromechanical power members (6), two on the right side, one under each of first panel (1) and second panel (2) and two on the left side, one under each of first panel (1) and second panel (2) which are connected together via hinges on each side respectively. The third side of each bracket frame which is the end adjacent to the bed boards connects the right side to the left side by a connecting lateral bar member, and the fourth side of each bracket frame which is the side at the midsection of the bed, centerline (a), includes a track bar (5) for the tray that connects the right side to the left side of each bracket frame. Each bracket frame is connected to the main frame via two electromechanical vertical bars (9) at the center of each panel which support the elevations of the panels. Shown in the figure is a feature of the bed with an inclined backrest and elevated foot section. Each of the two track bars for positioning the sliding tray is located, one at inner end of first half section and the second one at inner end of second half section. Also shown in figure are a side push button (10), and the integrated keypad (11) for operation of the bed.

Figure 1D:
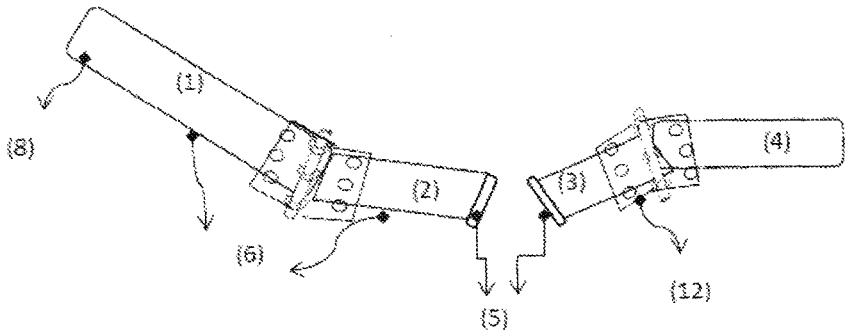
FIG. 1D illustrates the hinges (12) connecting first panel and second panel together and the third panel and fourth Panel together, and the track bars (5) on a side of third panel and a side of fourth panel that are adjacent to the centerline (a).

Referring to FIG. 1D, the four power members (6), two on the right side and two on the left side of each bracket frame (8) are connected together via hinges (12) under the panels that connect first panel and second panel (2) together in the first half, and third panel (3) and fourth panel (4) together in the second half of the bed.

Figure 2:
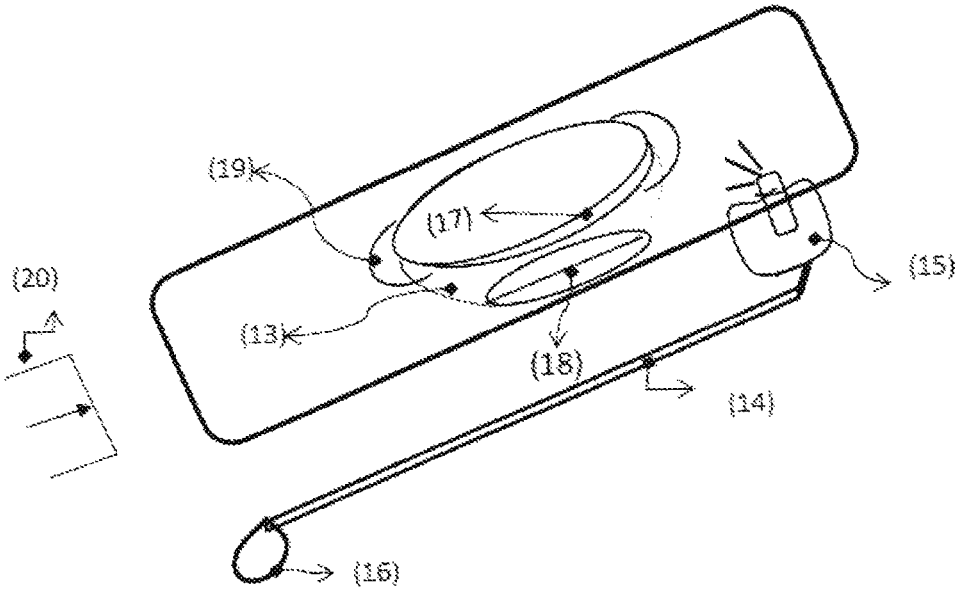
FIG. 2 illustrates the tray with the bed pan (13), bed pan sliding lid (17), side-lid push down for opening the bottom (19), the bottom opening (18); and, spray soap dish (15), the hose connecting the pump to the soap dish (14), and the pump to spray the fluid from the soap dish (16). The direction of sliding of tray is shown in (21).

Referring to FIG. 2, the tray has a built-in bed pan (13) in its center and a soap dish (15) adjacent to the pan that has a head spray on the surface of the tray. The bed pan has a sliding lid (17) that will open through a push when sliding in the bed and closes when sliding out; and an opening at the bottom (18) that would open with a push on the side lid (19) to flush away the disposable lining inside the pan. It is possible to utilize powered instruments at the bottom opening of the pan for flushing away in some situations. The tray also has a manual pump (16) that would spray the cleaning soap to affected area via head spray of soap dish (15). The integrator "bed-pan" tray slides in on the pair of track bars from one side of the bed to the other side (20), and once it reaches the other side of the bed, it locks its position at the center of the bed. The tray is flexible in size to accommodate narrower opening.

Figure 3:
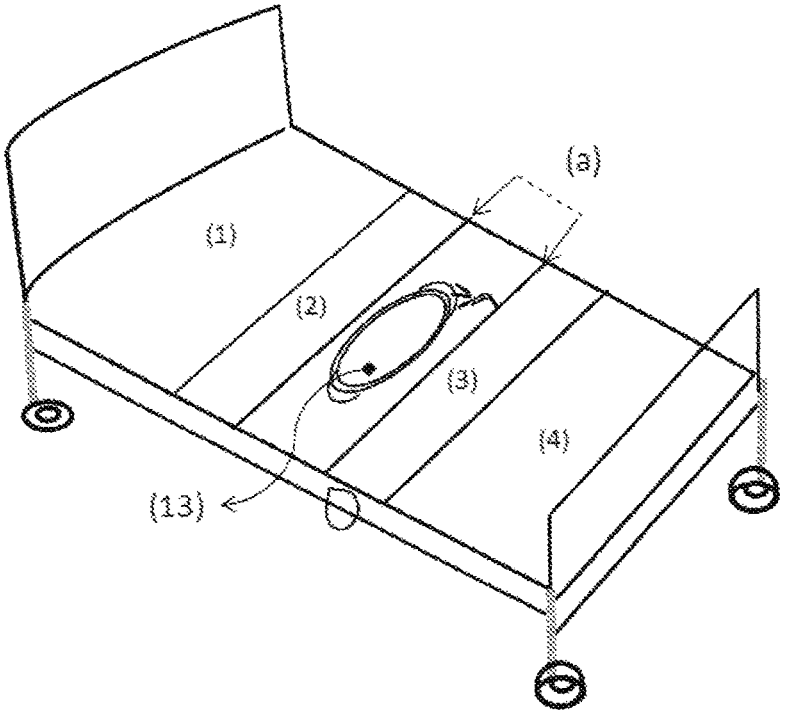
FIG. 3 illustrates a flat position of the bed with bed pan (13) placed in the midsection.

Referring to FIG. 3 the first half section has moved six inches toward the headboard and the second half section has fully extended to the footboard which together have left a twelve inch opening at centerline (a) for the tray. The tray slit in on the designated track, fit seamlessly between the two halves of the bed and can remain there for the needed period of time. This configuration allows patients to perform in a lay down position where they are not able to move up.

Figure 4:
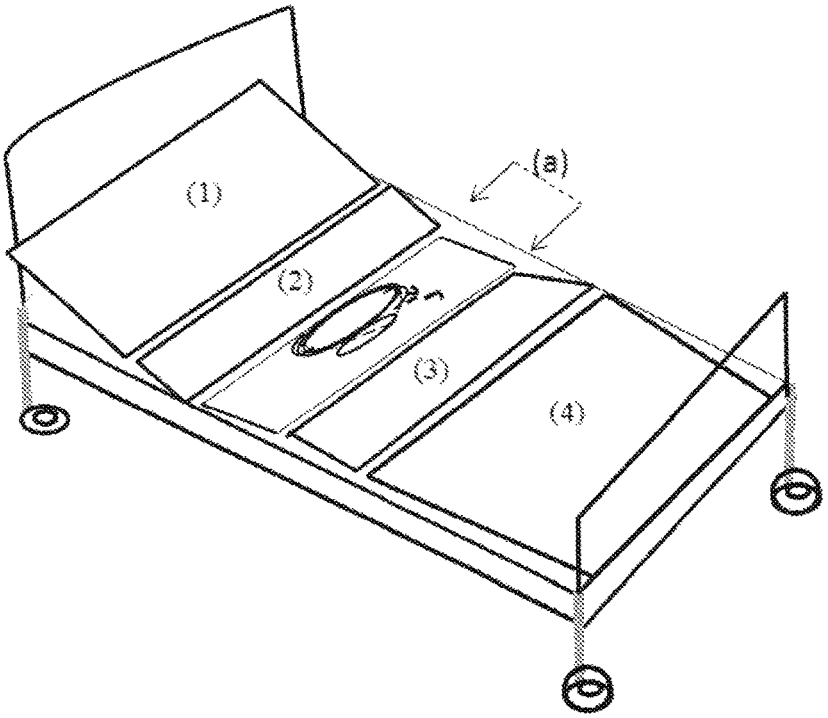
FIG. 4 illustrates the bed in an inclined setting such as raised in line (b) and line (c) to furnish a sitting position with bed pan placed in the midsection.

Referring to FIG. 4 bed is in toilet configuration as explained in FIG. 3 with elevated sections to emulate a sitting position at desire of the patient. At the center of the bed frame, line (a) there is a lock that will lock the tray once it slit in. The maximum opening for the tray is about twelve inches and it can be adjusted to accommodate petite and small size patients. It is foreseeable for this development to be upgraded by automating the tray sliding via electronics.

The invention claimed is:

1. A hospital bed system comprising:

a main frame consisting of four sides including a first right side, a second left side, wherein the first right side and the second left side are attached together by a first lateral bar at a head side forming a third side of the main frame, wherein a headboard is mounted on the first lateral bar and a footboard is mounted on the second lateral bar and the main frame includes frame includes four legs;

a platform consisting of four connected tiltable panels that can tilt and move individually or in combination to reconfigure the bed into different configurations, wherein one end of a first panel is positioned adjacent to the headboard, an opposite end of the first panel is attached to a second panel via hinges wherein the first and second panels together form a first half of the platform and there is a first six inch gap between the first half of the platform and the headboard; a third panel is positioned adjacent to the second panel at a first end and at its second end is attached via hinges to a fourth panel, wherein the fourth panel is positioned adjacent to the footboard and the third and the fourth panel form a second half of the platform and there is a second six inch gap between the second half of the platform and the footboard;

the first half of the platform and the second half of the platform make contact at a centerline, wherein the second panel and the third panel are immediately adjacent to the centerline and are movable with respect to each other to form an opening between the first half and the second half of the platform at a midsection of the bed; wherein opening of the midsection is performed by a push button on the side of the bed or an integrated keypad;

two bracket frames wherein one bracket frame supports movement of the first half of the platform and the second bracket frame supports movement of the second half of the platform;

the first bracket frame includes two power members on a first longitudinal side, a first of said power members is positioned below the first panel and a second of the power members is positioned below the second panel, wherein the two power members are connected via hinges, the first bracket frame further includes two additional power members on a second longitudinal side, the first additional power member is positioned below the first panel and the second additional power member is positioned below the second panel, wherein the two additional power members are connected via hinges, wherein the first longitudinal side is connected to the second longitudinal side via a lateral bar member adjacent to the headboard and further connected via a track bar for a sliding tray adjacent to the centerline;

the second bracket frame includes two power members on a first longitudinal side, a first of said power members is positioned below the fourth panel and a second of the power members is positioned below the third panel, wherein the two power members are connected via hinges, the second bracket frame further includes two additional power members on a second longitudinal side, the first additional power member is positioned below the fourth panel and the second additional power member is positioned below the third panel, wherein the two additional power members are connected via hinges, wherein the first longitudinal side is connected to the second longitudinal side via a lateral bar member adjacent to the footboard and further connected via a track bar for a sliding tray adjacent to centerline;

wherein the first bracket frame and the second bracket frame are attached to the main frame by additional power members to support the tilting and elevation of the panels, wherein all of the power members are powered by a motor located under the platform such that the first bracket frame is configured to move the first half of the platform toward the headboard and the second bracket frame is configured to move the second half of the bed toward the footboard forming the opening at the midsection between the track bar of the first bracket frame and the track bar of the second bracket frame; and wherein a tray is configured to slide into position on the track bar of the first bracket frame and the track bar of the second bracket frame.

2. The hospital bed system of claim 1 wherein the tray includes a built-in bed pan and a spray soap dish, wherein the tray is configured to slide into position on the track bar of the first bracket frame and the track bar of the second bracket frame and lock into place within the opening wherein the built-in bed pan has a lid that slides open and close and a bottom that opens to remove a disposable lining positioned within the pan and the spray soap dish includes a head spray positioned on a surface of the tray operable by a manual pump, wherein the manual pump is configured to supply cleaning fluids to the head spray.

* * * * *